US006503110B2

(12) United States Patent
Lammli

(10) Patent No.: US 6,503,110 B2
(45) Date of Patent: Jan. 7, 2003

(54) LOWER UNIT GUARD FOR AN OUTBOARD MOTOR

(76) Inventor: Ernest Lammli, P.O. Box 144, Cherhill, Alberta (CA), T0E 0J0

( * ) Notice: Subject to any disclaimer, the term of this patent is extended or adjusted under 35 U.S.C. 154(b) by 0 days.

(21) Appl. No.: 09/847,572

(22) Filed: May 2, 2001

(65) Prior Publication Data

US 2001/0041483 A1 Nov. 15, 2001

(30) Foreign Application Priority Data

May 4, 2000 (CA) ..... 2307489
Jun. 6, 2000 (CA) ..... 2310859

(51) Int. Cl.[7] ..... B63H 5/16
(52) U.S. Cl. ..... 440/71; 416/247 A
(58) Field of Search ..... 440/71, 72; 416/247 A

(56) References Cited

U.S. PATENT DOCUMENTS

| | | | | |
|---|---|---|---|---|
| 2,319,640 A | * | 5/1943 | Sink | 440/71 |
| 3,939,795 A | * | 2/1976 | Rocka | 440/78 |
| 4,070,984 A | | 1/1978 | Kappas | 115/42 |
| 4,565,533 A | | 1/1986 | Springer | 440/71 |
| 4,637,801 A | | 1/1987 | Schultz | 440/67 |
| 4,680,017 A | | 7/1987 | Eller | 440/66 |
| 4,718,871 A | | 1/1988 | Mendelevitch | 440/71 |
| 4,925,412 A | | 5/1990 | Karls | 440/71 |
| 5,018,997 A | | 5/1991 | Guptill | 440/76 |
| 5,176,550 A | | 1/1993 | Hooper | 440/72 |
| 5,178,565 A | | 1/1993 | Jacobson | 440/71 |
| 5,839,929 A | | 11/1998 | Cousins | 440/76 |

FOREIGN PATENT DOCUMENTS

| | | | |
|---|---|---|---|
| CA | 2227266 | 9/2000 | B63H/21/36 |

* cited by examiner

*Primary Examiner*—Sherman Basinger
(74) *Attorney, Agent, or Firm*—Davis & Bujold, P.L.L.C.

(57) ABSTRACT

A lower unit guard for an outboard motor includes a mounting adapted to be secured onto a flange on a housing of a boat motor. The mounting has a leading edge. A skeg receiving pocket is provided which is adapted to receive a skeg of the boat motor. The skeg receiving pocket is adapted to accommodate in close fitting relation the skeg in its entirety. The skeg receiving pocket has a leading edge, a trailing edge and a bottom edge. A reinforcement member is adapted to fit the contours of a lower unit of a boat motor. The reinforcement member has an upper extremity secured to the leading edge of the mounting and a lower extremity secured to the leading edge of the skeg receiving pocket.

1 Claim, 4 Drawing Sheets

LOWER UNIT GUARD FOR AN OUTBOARD MOTOR

FIELD OF THE INVENTION

The present invention relates to a lower unit guard for an outboard motor.

BACKGROUND OF THE INVENTION

U.S. Pat. No. 5,839,929 discloses a lower unit guard for a boat motor. This lower unit guard has mounting plates that extend only partially across the skeg of the boat motor. The lower unit guard is secured to the boat motor by a bolt passing through the side mounting plates and the skeg. The problem with this type of mounting is that the bolt hole weakens the Skeg. Upon a jarring force being exerted upon the lower unit guard, the bolt tends to tear right through the skeg. For this reason, dealers of boat motors are presently indicating to their customers that the manufacturer's warranty will be voided if any holes are placed in the skeg.

U.S. Pat. No. 5,178,565 discloses a lower unit guard that has a skeg pocket in which a lower tip of the skeg is received. The problem with this type of mounting is that there is not much strength at the lower tip of the skeg. Upon a jarring force being exerted upon the lower unit guard, the skeg tends to bend or break off.

SUMMARY OF THE INVENTION

What is required is an alternative form of lower unit guard.

According to the present invention there is provided a lower unit guard for an outboard motor which includes a mounting adapted to be secured onto a flange on a housing of a boat motor. The mounting has a leading edge. A skeg receiving pocket is provided which is adapted to receive a skeg of the boat motor. The skeg receiving pocket is adapted to accommodate in close fitting relation the skeg in its entirety. The skeg receiving pocket has a leading edge, a trailing edge and a bottom edge. A reinforcement member is adapted to fit the contours of a lower unit of a boat motor. The reinforcement member has an upper extremity secured to the leading edge of the mounting and a lower extremity secured to the leading edge of the skeg receiving pocket.

The lower unit guard, as described above, provides a more secure installation that will not be as prone to damage the skeg when subjected to a jarring impact. This is accomplished by several factors. The first factor is having the skeg pocket fit the skeg in close fitting relation so there can be no movement of the skeg within the pocket. The second factor is having the skep pocket accommodate the skeg in its entirety, so that any force acting upon the skeg is spread over the entire skeg.

Although beneficial results may be obtained through the lower unit guard, as described above, even more beneficial results may, therefore, be obtained when the reinforcing member has an underlying portion that underlies the skeg receiving pocket. This configuration adds additional rigidity to the skeg pocket, so that, to the greatest extent possible, it is the lower guard unit and not the skeg itself that absorbs the impact.

The most common mounting for securing the upper extremity of the reinforcing member is to position an attachment bracket that has bolt holes that align with the bolt holes on the flange that secure the upper and lower portions of the housing of the outboard motor together. Unfortunately, the spacing of the bolt holes varies with different manufacturers and different sizes of outboard motor. Even more beneficial results may, therefore, be obtained when a mounting clamp is positioned at the upper extremity of the reinforcing member. The clamp includes a first clamping member, a second clamping member and means for maintaining the first clamping member and the second clamping member in clamping engagement.

The clamping attachment at the upper extremity, as described above, enables the lower unit guard to be more readily mounted on outboard motors of different sizes and made by different manufacturers.

Although beneficial results may be obtained through the use of the lower unit guard, as described above, the clamp is more effective when one or both one of the first clamping member and the second clamping member has a cavity adapted to receive a flange on an outboard motor.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1:
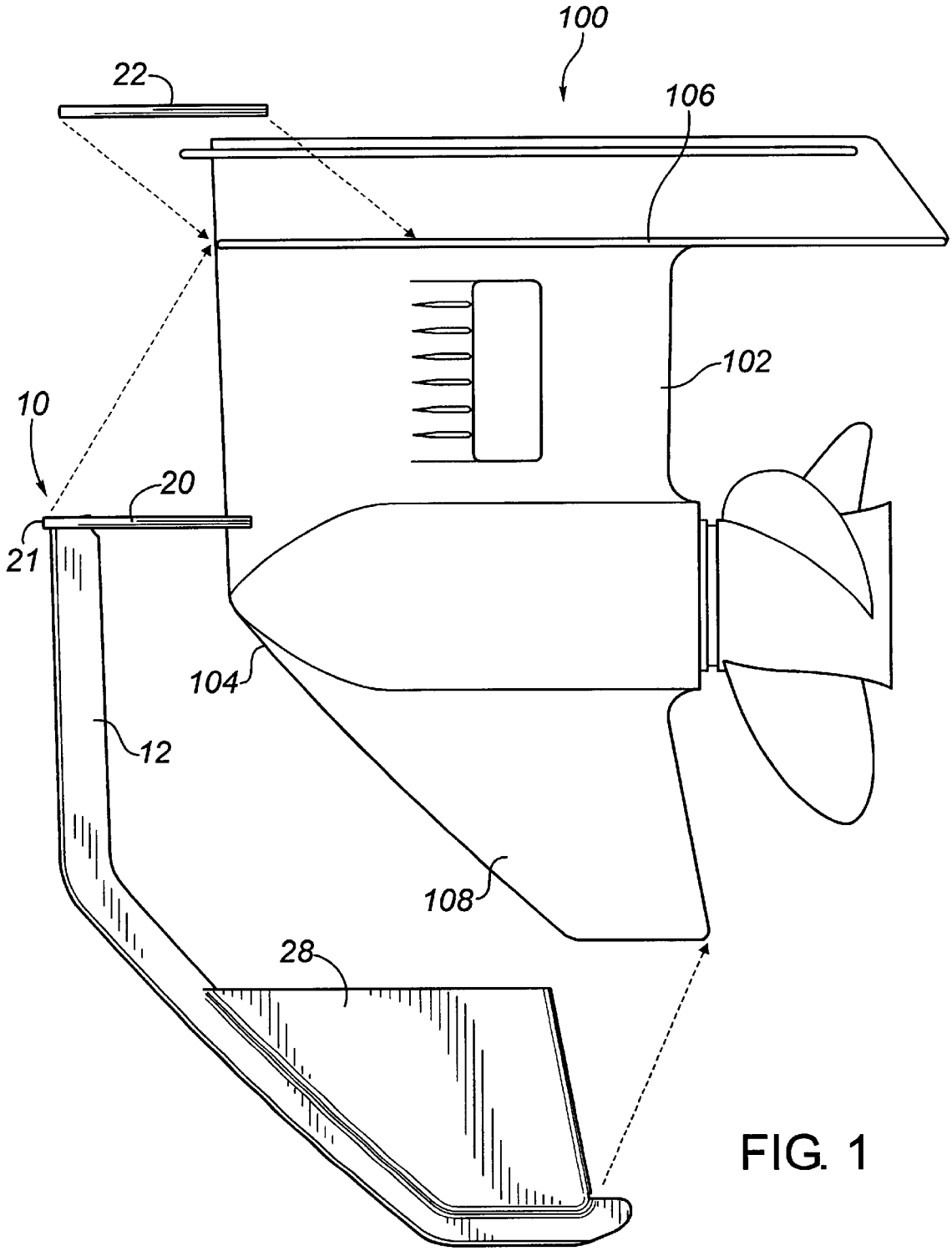
FIG. 1 is a first exploded side elevation view of a lower unit guard constructed in accordance with the teachings of the present invention and an outboard motor.

The preferred embodiment, a lower unit guard for an outboard motor generally identified by reference numeral 10, will now be described with reference to FIGS. 1 through 5.

Figure 5:
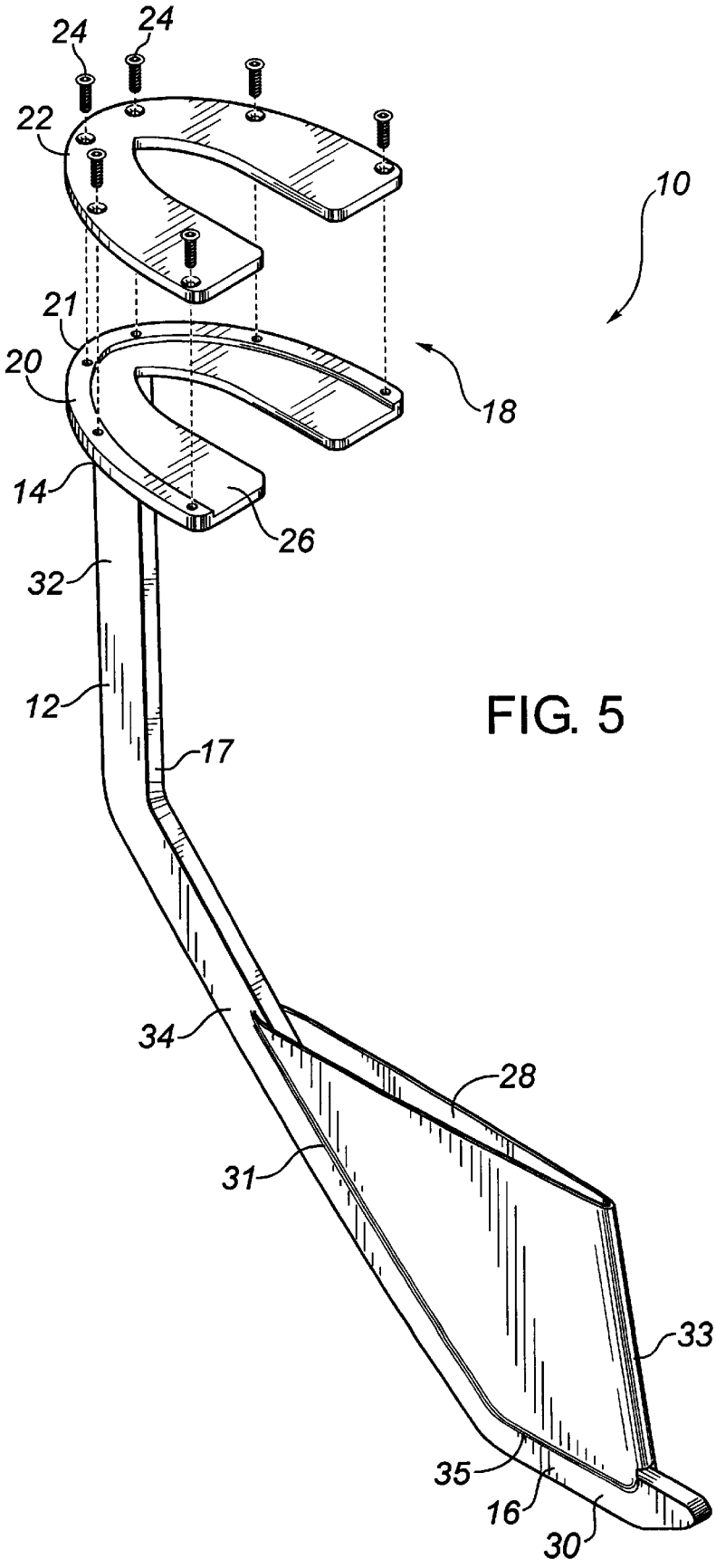
FIG. 5 is an exploded perspective view of a lower unit guard illustrated in FIG. 1.

Structure and Relationship of Parts:

Referring to FIG. 5, lower unit guard 10 includes a reinforcing member 12. Reinforcing member 12 is adapted to be positioned along a leading edge of a lower unit of an outboard motor, as will hereinafter be further described. Reinforcing member 12 has an upper extremity 14, a lower extremity 16 and a groove 17 extending from upper extremity 14 to lower extremity 16 to accommodate a leading edge of a lower unit of an outboard motor. A mounting clamp, generally indicated by reference numeral 18, is positioned at upper extremity 14 of reinforcing member 12. Clamp 18 includes a first clamping member 20, a second clamping member 22 and several rotatable fasteners 24 which serve to maintain first clamping member 20 and second clamping member 22 in clamping engagement. First clamping member 20 has a cavity 26 which is adapted to receive a flange on an outboard motor, as will hereinafter be further described. Mounting clamp 18 has a leading edge 21.

A skeg receiving pocket 28 is positioned at lower extremity 16 of reinforcing member 12. Skeg receiving pocket 28 is used to secure lower extremity 16 of reinforcing member 12 to a skeg of an outboard motor, as will hereinafter be further described. Skeg receiving pocket 28 has a leading edge 31, a trailing edge 33 and a bottom edge 35.

Upper extremity 14 of reinforcing member 12 is secured to leading edge 21 of mounting clamp 18. Lower extremity of 16 of reinforcing member 12 is secured to leading edge 31 of skeg receiving pocket 28. Reinforcing member 12 has an underlying portion 30 that extends long bottom edge 35 and underlies skeg receiving pocket 28, a perpendicular portion 32 that extends substantially perpendicularly from clamp 18, and an angular portion 34 that extends at an angle along leading edge 31 of skeg receiving pocket 28 between underlying portion 30 and perpendicular portion 32.

Figure 2:
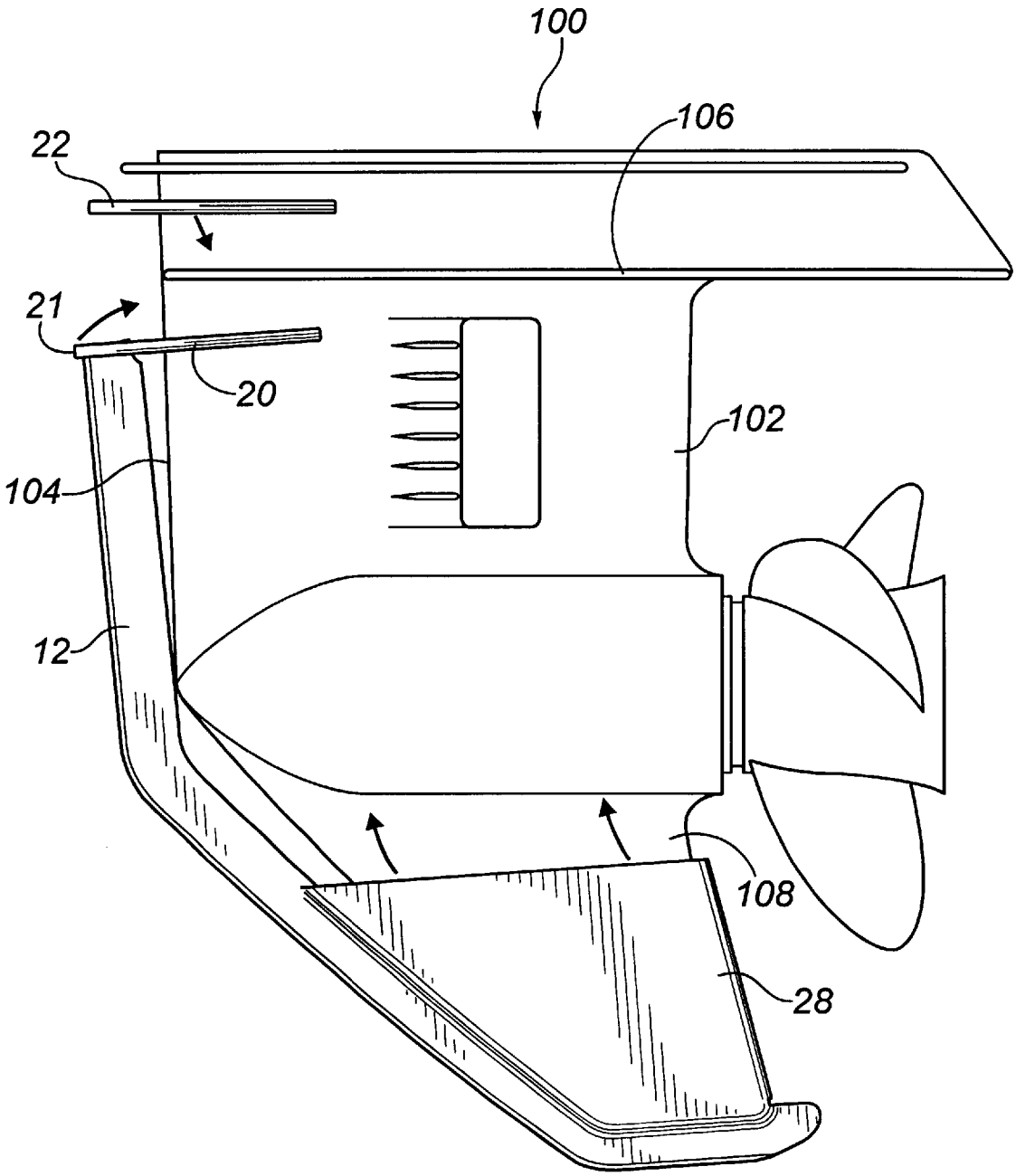
FIG. 2 is a side elevation view of the lower unit guard illustrated in FIG. 1 being placed onto the outboard motor.
Figure 3:
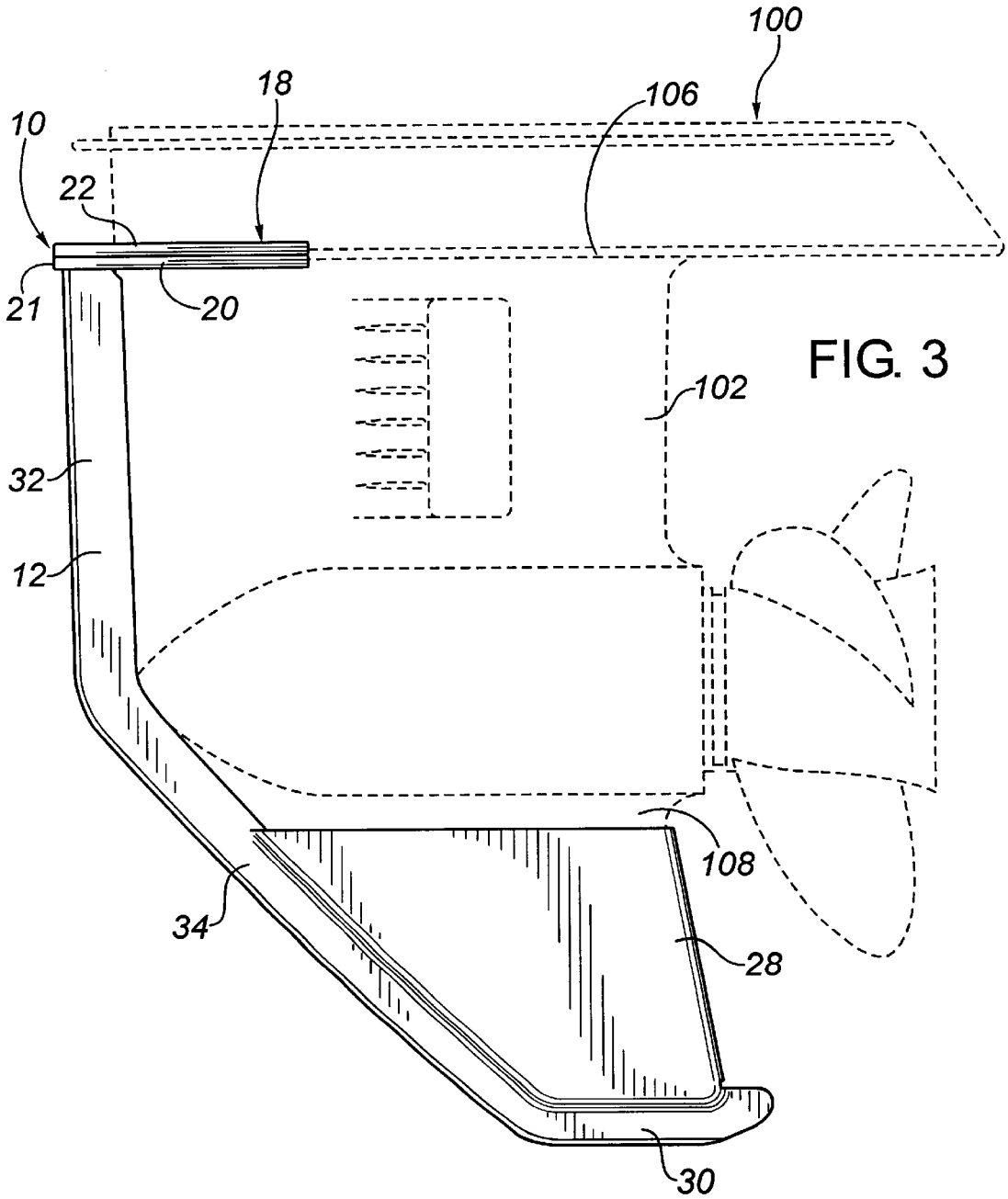
FIG. 3 is a side elevation view of the lower unit guard illustrated in FIG. 1, positioned on the outboard motor.
Figure 4:
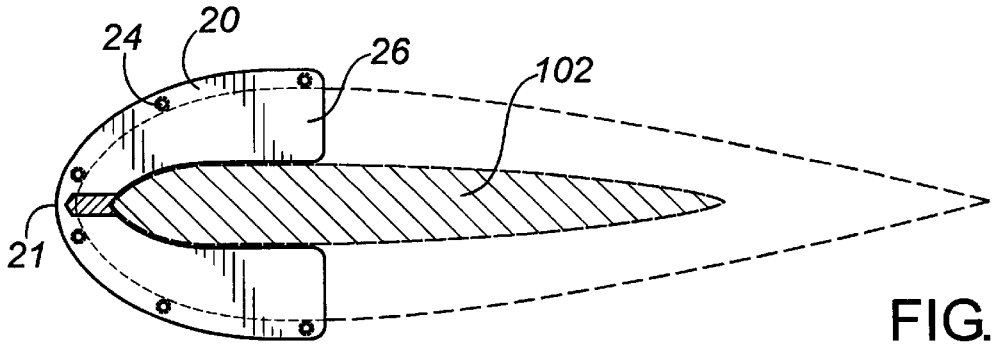
FIG. 4 is a top plan view , in section, of the lower unit guard and outboard motor illustrated in FIG. 3.

Operation:

The use and operation of lower unit guard 10 will now be described with reference to FIGS. 1 through 5. Referring to FIG. 1, there is illustrated an outboard motor which is generally identified by reference numeral 100. Portions of outboard motor 100 necessary for a description of the use and operation of lower unit guard 10 will now be identified. A lower unit 102 of outboard motor 100 is illustrated. Lower unit has a leading edge 104, a flange 106, and a skeg 108. Referring to FIG. 2, skeg 108 is positioned in skeg receiving pocket 28. This serves to secure lower extremity 16 of reinforcing member 12 to skeg 108. Referring to FIG. 3, first clamping member 20 and second clamping member 22 of clamp 18 are then clamped onto flange 106. Referring to FIG. 4, flange 106 is positioned in cavity 26 and rotatable fasteners 24 clamp first clamping member 20 and second clamping member 22 onto flange 106.

Referring to FIG. 3, when lower unit guard 10 is in position, skeg 108 is protected within skeg receiving pocket 28, with skeg receiving pocket 28 being reinforced by underlying portion 30 and angular portion 34 of reinforcing member 12. Leading edge 104 of lower unit 102 is positioned in groove 17 where it is protected by the positioning of reinforcing member 12. Clamp 18 engages flange 106 to maintain lower unit guard 10 in position.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the claims.

The embodiments of the invention in which an exclusive property or privilege is claimed are defined as follows:

1. A lower unit guard for an outboard motor, comprising:

a reinforcing member adapted to be positioned along a leading edge of a lower unit of an outboard motor, the reinforcing member having an upper extremity and a lower extremity;

a mounting clamp positioned at the upper extremity of the reinforcing member, the clamp including a first clamping member, a second clamping member and rotatable fasteners for maintaining the first clamping member and the second clamping member in clamping engagement, at least one of the first clamping member and the second clamping member having a cavity adapted to receive a flange on an outboard motor;

a skeg receiving pocket at the lower extremity of the reinforcing member whereby the lower extremity is secured to a skeg of an outboard motor; and the reinforcing member having an underlying portion that underlies the skeg receiving pocket, a perpendicular portion that extends substantially perpendicularly from the clamp, and an angular portion that extends at an angle along one edge of the skeg receiving pocket between the underlying portion and the perpendicular portion.

* * * * *